US006857527B2

(12) United States Patent
Hu

(10) Patent No.: US 6,857,527 B2
(45) Date of Patent: Feb. 22, 2005

(54) TOOL RACK WITH ANTI-THEFT, DISPLAY, AND TRY-ON FUNCTIONS

(76) Inventor: Bobby Hu, 8F. No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 10/306,981

(22) Filed: Nov. 29, 2002

(65) Prior Publication Data

US 2003/0080076 A1 May 1, 2003

Related U.S. Application Data

(63) Continuation-in-part of application No. 09/718,510, filed on Nov. 24, 2000, now abandoned.

(51) Int. Cl.[7] ..... A47F 7/00
(52) U.S. Cl. ..... 211/70.6; 206/478
(58) Field of Search ..... 211/70.6, 87.01; D9/415; 206/376, 565, 372, 370, 349, 483, 378, 377, 481, 493, 478, 482, 479, 488; 40/668, 669, 665

(56) References Cited

U.S. PATENT DOCUMENTS

| | | | | |
|---|---|---|---|---|
| 3,214,808 A | * | 11/1965 | Litwin | 24/16 PB |
| 3,516,124 A | * | 6/1970 | Merser | 24/16 PB |
| 4,019,632 A | | 4/1977 | Greenlee | |
| 4,311,236 A | * | 1/1982 | Johnson | 206/488 |
| 4,450,961 A | | 5/1984 | Bies et al. | |
| 4,506,415 A | * | 3/1985 | Swift | 24/16 PB |
| 4,711,352 A | * | 12/1987 | Williams et al. | 206/365 |
| 4,712,683 A | * | 12/1987 | Cazin | 206/478 |
| 4,811,844 A | * | 3/1989 | Moulding et al. | 206/459.5 |
| 4,911,297 A | | 3/1990 | Suburu | 206/376 |
| 5,036,975 A | | 8/1991 | Chow | 206/376 |
| 5,317,787 A | | 6/1994 | Fortsch | 24/16 PB |
| 5,477,964 A | | 12/1995 | Hart | |
| 5,509,528 A | | 4/1996 | Weisburn | 206/45.25 |
| 5,730,303 A | | 3/1998 | Chow | 211/70.6 |
| 5,785,174 A | | 7/1998 | Chow | |
| 5,899,329 A | | 5/1999 | Hu et al. | 206/376 |
| 5,931,299 A | | 8/1999 | Hsieh | 206/376 |
| 5,941,386 A | | 8/1999 | Hu et al. | 206/376 |
| 5,988,381 A | | 11/1999 | Ling | |
| D426,151 S | | 6/2000 | Ling | D9/415 |
| 6,126,004 A | | 10/2000 | Ling | 206/377 |
| 6,164,463 A | | 12/2000 | Lee | 211/70.6 |
| 6,241,208 B1 | | 6/2001 | Lin | 248/309.1 |
| 6,257,409 B1 | | 7/2001 | Lin | 206/376 |
| 6,409,015 B1 | | 6/2002 | Hu | |
| 6,637,606 B1 | * | 10/2003 | Chen | 211/70.6 |
| 6,655,063 B2 | * | 12/2003 | Goodin et al. | 40/665 |
| 6,679,391 B1 | * | 1/2004 | Huang | 211/70.6 |
| 2003/0080076 A1 | * | 10/2003 | Hu | 211/70.6 |
| 2003/0183591 A1 | * | 10/2003 | Ling | 211/70.6 |
| 2004/0000497 A1 | * | 1/2004 | Huang | 206/376 |

* cited by examiner

*Primary Examiner*—Carl D. Friedman
*Assistant Examiner*—Jennifer E. Novosad
(74) *Attorney, Agent, or Firm*—Alan Kamrath; Nikolai & Mersereau PA

(57) ABSTRACT

A tool rack includes a board, a number of tool holding members for holding tools, and a number of upwardly extending hooks. The tools can be simply hung up to the upwardly extending hooks when used indoors. The upwardly extending hooks not only prevent tools from falling from the tool rack but also provide convenient retrieval of the tools of the type having at least one box end. Each tool holding member and the board has a space therebetween. A strap is simultaneously slid into the spaces along a direction transverse to an extending direction of each tool and extended over all of the tools, thereby rapidly tying up all tools on the tool rack. A rotary member is provided on the board, allowing try-on of the tools.

17 Claims, 11 Drawing Sheets

TOOL RACK WITH ANTI-THEFT, DISPLAY, AND TRY-ON FUNCTIONS

CROSS REFERENCE TO RELATED APPLICATION

This is a continuation-in-part application of U.S. patent application Ser. No. 09/718,510 filed on Nov. 24, 2000, which is now abandoned.

BACKGROUND OF THE INVENTION

1. Field of the Invention

The present invention relates to a tool rack with anti-theft, display, and try-on functions.

2. Description of the Related Art

Tool racks generally provide a simple function of holding tools and some of them include holes so as to be hung up to a wall. Although some tool racks include positioning members for positioning tools, the tools, especially spanners, still might fall from the tool racks. U.S. Pat. No. 5,931,299 to Hsieh discloses a tool holder including a plurality of vertically spaced retainer blocks on a side of a flat base of the tool holder and a plurality of tool receiving grooves defined by a plurality of locating ribs. A box end of a tool can be retained by a respective retainer block, and the tool is retained by two resilient retainer rods in a respective tool receiving groove at a position adjacent to the other end of the tool. However, the tool has to be retained by both the retainer block and the resilient retainer rods. Retrieval of the tool is troublesome. Namely, the user has to disengage the tool from the retainer rods before removing the tool from the tool holder. Use of the tool rack is thus inconvenient to the user. Other tool racks provide display and try-on functions to allow the consumer to try the spanner before buying it. However, all of the spanners on a tool rack are readily accessible during display such that a thief may steal them without any difficulty. U.S. Pat. No. 5,730,303 to Chow discloses a hand tool rack that includes a strap for retaining the spanners in place, but the user has to tie up the tools one by one by means of passing the strap through the slot on each tool holding member. However, a thief can remove the strap and steal the spanners within several seconds although the tying up procedure is time-consuming in the tool rack of U.S. Pat. No. 5,730,303.

SUMMARY OF THE INVENTION

It is an object of the present invention to provide a multifunctional tool rack with anti-theft, display, and try-on functions.

It is another object of the present invention to provide a tool rack allowing easy retrieval of tools held by the tool rack, the tools being of the type having at least one box end.

In accordance with a first aspect of the invention, the tool rack comprises:

a board;

a plurality of tool holding members defining a plurality of longitudinally extending tool holding seats each for holding one of the plurality of tools, each said tool holding member having first and second longitudinally spaced ends, with a space being defined by and between the board and at least one of the tool holding members, each said space having an opening at one of the first and second longitudinal ends of the tool holding member; and a strap slidable perpendicular to the longitudinally extending tool holding seats and extendable over at least one of the tools held by the tool holding members and simultaneously slidable through the openings into the spaces along a direction substantially parallel to the longitudinally extending tool holding seats, with said strap being releasably attached to said board, thereby rapidly retaining said at least one of the plurality of tools in place.

In accordance with a second aspect of the invention, the tool rack comprises:

a board having an upper end;

at least one hanging hole being defined in the board for hanging the board in a vertical orientation;

a plurality of tool holding members defining a plurality of longitudinally extending tool holding seats each for holding one of the plurality of tools, with the plurality of longitudinally extending tool holding seats being vertical when the board is hung in the vertical orientation by the at least one hanging hole; and a plurality of upwardly extending hooks on the upper end of the board above the tool holding members when the board is hung in the vertical orientation by the at least one hanging hole, with each said upwardly extending hook being aligned with one of the longitudinally extending tool holding seats and for hanging the box end of the tool, with the upwardly extending hooks being capable of hanging said box end of each said tool without said tool being retained in place in the longitudinally extending tool holding seat.

The board may further include a rotary member mounted thereto for engaging with an end of a tool for try-on.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
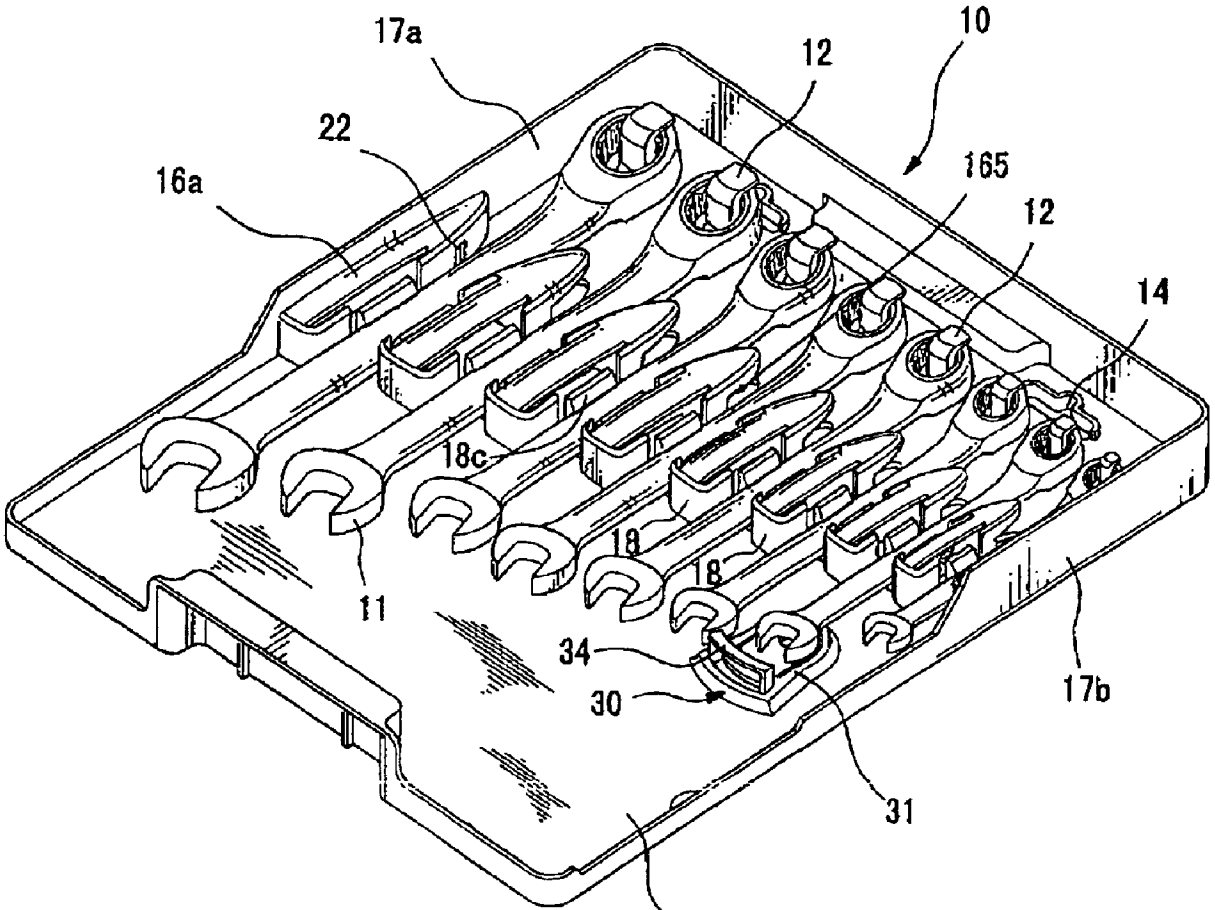
FIG. 1 is a perspective view of a tool rack in accordance with the present invention.
Figure 2:
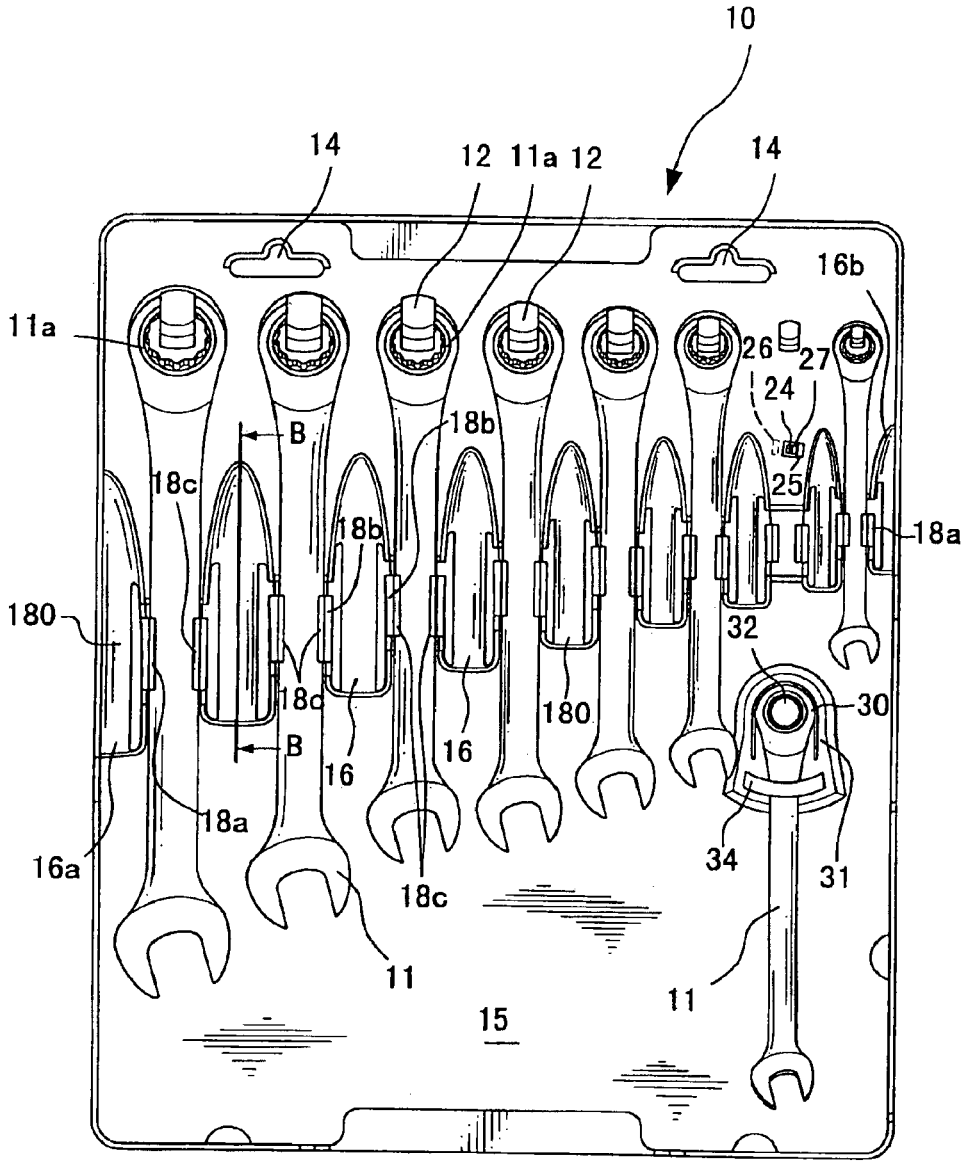
FIG. 2 is a top view of the tool rack in accordance with the present invention.

Referring to FIGS. 1 and 2, a tool rack in accordance with the present invention generally includes a main body 10 having a board 15 and two side walls 17*a* and 17*b* extending upright from two sides of the board 15, respectively. Top and bottom walls extend between the upper and lower edges of the side walls 17*a* and 17*b* and each include a handle well, with the handle well of the bottom wall having a greater extent from the board 15 than the handle well of the top wall. The main body 10 further includes at least one hanging hole 14 to allow hanging of the tool rack up to a wall in a vertical orientation.

Figure 5:
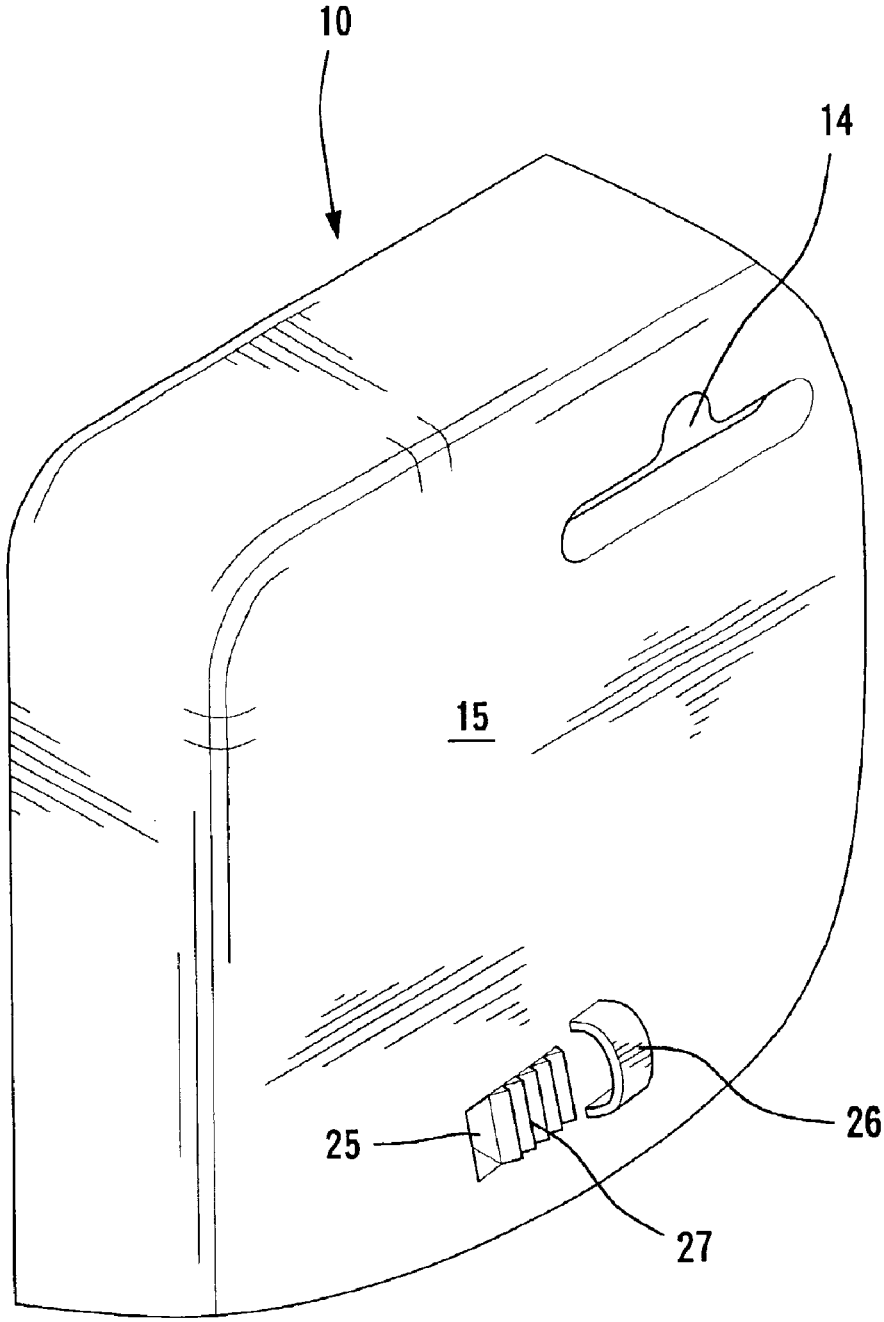
FIG. 5 is a partial perspective view illustrating a rear side of a modified embodiment of the tool rack.

The board 15 includes a retaining portion 24 (FIG. 2) that is in the form of a through-hole 25 and a plurality of retaining teeth 27 provided on an upper side (see the embodiment of FIG. 2) or an underside (see the embodiment of FIG. 5) of the board 15 and adjacent to the through-hole 25. A retainer member 26 (FIG. 5) is formed on the underside of the board 15 and adjacent to the retaining portion 24.

A plurality of tool retaining or holding members 16 is provided on the upper side of the board 15 for holding tools (e.g., spanners or combination wrenches) 11. In the preferred form as shown, the tools 11 have a box end 11*a*, and in the most preferred form, the tool rack in accordance with the present invention has advantageous application to tools 11 of the type best seen in FIG. 9 having their box ends 11*a* angled at an obtuse angle to the handle portion or to the entire remaining portion of the tool 11. Each side wall 17*a* and 17*b* also has a tool holding member 16*a* and 16*b* on an inner wall face thereof, wherein the tool holding member 16*a* (the left one in FIG. 2) has a retaining hole 22 (FIG. 1).

The above-mentioned tool holding members 16, 16*a*, and 16*b* are spaced apart from each other and thus define a longitudinally extending tool holding seat (not labeled) between each adjacent pair. Each of the tool holding members 16, 16*a*, and 16*b* include a panel 18 extending generally perpendicular to the board 15 and a top 180 integrally formed with the outer edges of the panel 18 and extending generally parallel to the board 15. In the most preferred form, panels 18 are generally rowboat shaped, with the front point of the boat shape being at a first, upper end and the rear of the boat shape being at a second, lower end of the tool holding members 16, 16*a* and 16*b*, with the first and second ends being longitudinally spaced. As illustrated in FIG. 2, each of the tool holding members 16*a* and 16*b* respectively formed on the side walls 17*a* and 17*b* has an inwardly facing positioning member 18*a* created in the panel 18 opposite to the side walls 17*a* and 17*b*. Each tool holding member 16 between the side walls 17*a* and 17*b* has a positioning member 18*b* on each of two sides thereof and created in panel 18. Each of the positioning members 18*a* and 18*b* has a resilient hook 18*c* for holding a side of a respective tool 11 such as a combination wrench. Namely, when the respective tool 11 is placed into the respective longitudinally extending tool holding seat between two adjacent tool holding members 16, 16*a* and 16*b*, the associated resilient hooks 18*c* are moved outward to allow passage of the respective tool 11 into the respective tool holding seat and then returns to its initial position due to its resiliency to thereby retain the opposite lateral sides of the respective tool 11 in place.

Each tool holding member 16 between the side walls 17*a* and 17*b* has a cutout 163 in the panel 18 in an upper end thereof. Particularly, the cutout 163 extends from the upper end of the panel 18 of each tool holding member 16 towards but spaced from the lower end of each panel 18 and spaced intermediate the board 15 and the top 180. Cutouts 163 terminate in edges 161 defined in opposite sides of the panel 18 and in the most preferred form extending generally perpendicular from board 15. In this embodiment, a space 160, preferably U-shaped, is defined between the inner edge of the cutout 163 of each tool holding member 16 and the board 15 and the edges 161 of the respective tool holding member 16 and has an upwardly-facing opening 162 in an upper end thereof, best shown in FIGS. 3A and 3B. The spaces 160 are aligned and communicated with one another.

The main body 10 further includes a rotary member 30 for engaging with an end of a tool 11 for try-on. In particular, the board 15 includes a U-shaped cut 31 with the free ends of the cut 31 being vertically downward when the board 15 is hung in a vertical orientation by the hanging holes 14. A rotary element 32 is rotatably mounted to the board 15 inside of the U-shaped cut 31. A U-shaped bracket 34 has legs integrally extending upward from the plane of the board 15 and vertically below the free ends of the U-shaped cut 31 when the board 15 is hung in a vertical orientation by the hanging holes 14 and has a center section integrally extending between the legs and parallel to the plane of the board 15, with the legs of the bracket 34 being spaced slightly greater than the free ends of the cut 31 in the most preferred form.

The board 15 of the main body 10 further includes a plurality of upwardly extending hooks 12 (substantially L-shaped) on an upper end of the board 15 for securely fixing an end (particularly a box end 11*a*) of a tool 11. Each upwardly extending hook 12 is aligned with a respective tool holding seat. Each upwardly extending hook 12 has an extent outwardly of the board 15 which is greater than the outward extent of the engagement of the resilient hooks 18*c* with the tool 11 of the associated longitudinally extending tool holding seat and which corresponds to the extent of the box end 11*a* of the tool 11 perpendicular to the board 15 when the tool 11 is received in the associated longitudinally extending tool holding seat. The hanging holes 14 are preferably located above the upwardly extending hooks 12.

Figure 3:
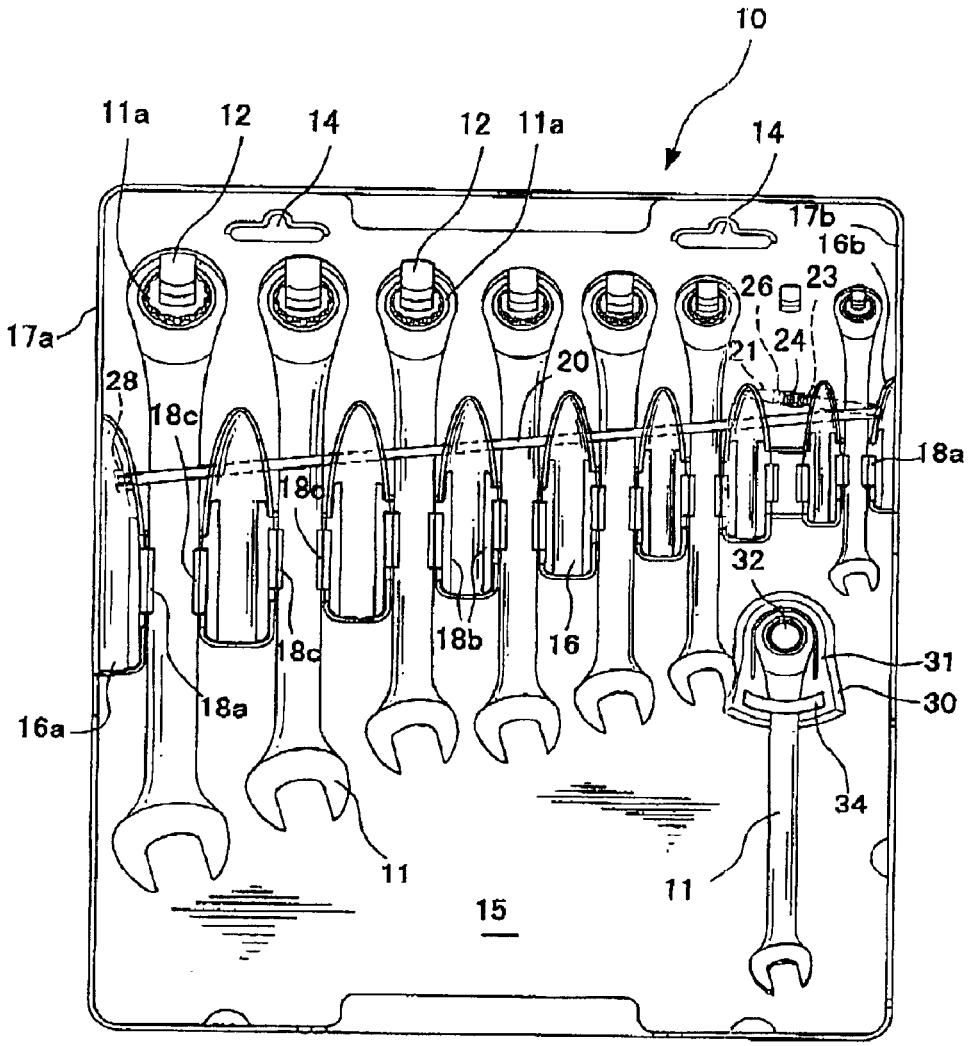
FIG. 3 is a top view similar to FIG. 2, illustrating use of a strap for anti-theft purposes.
Figure 3A:
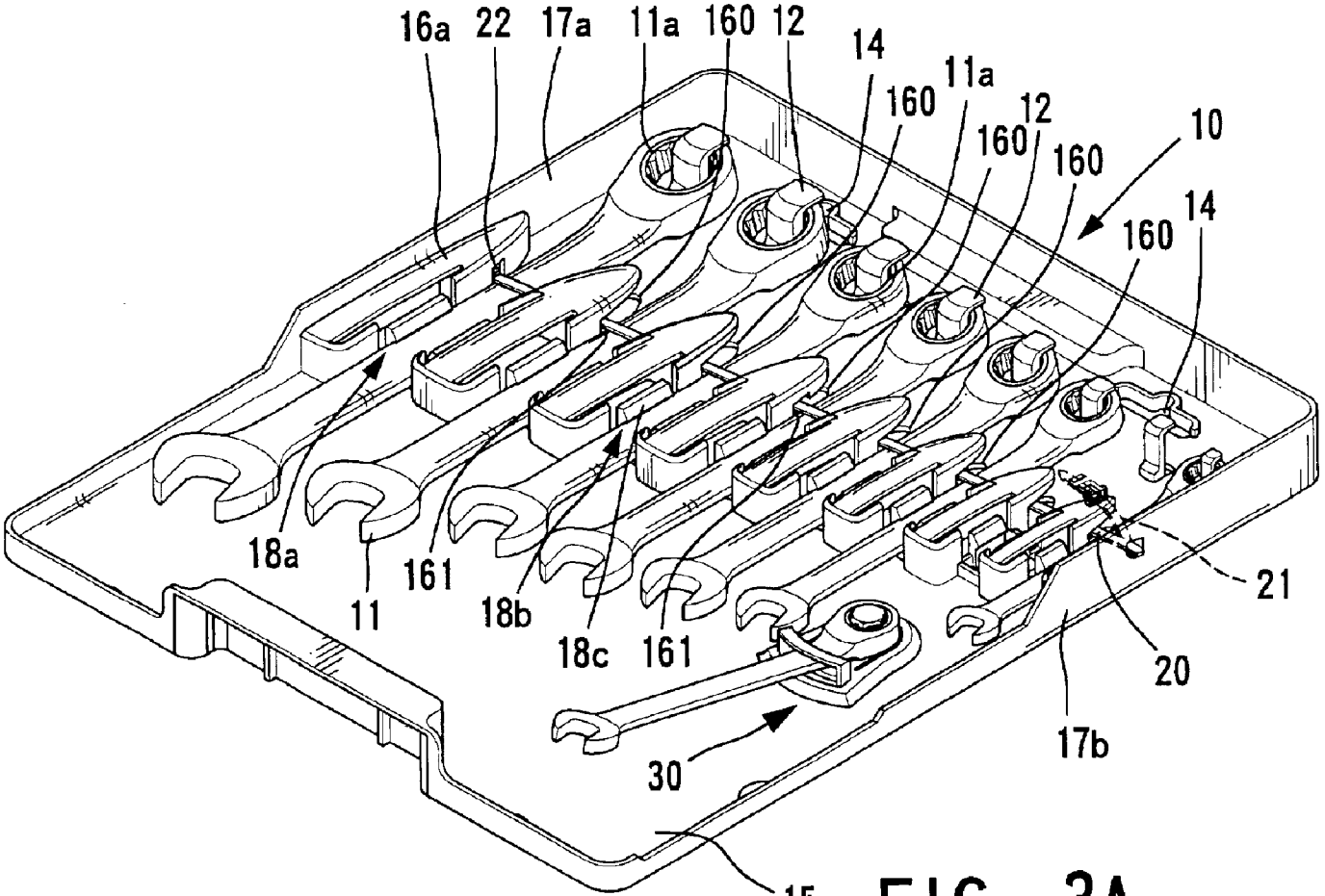
FIG. 3A is a perspective view of the tool rack in accordance with the present invention, illustrating easy tying up of tools by the strap.
Figure 3B:
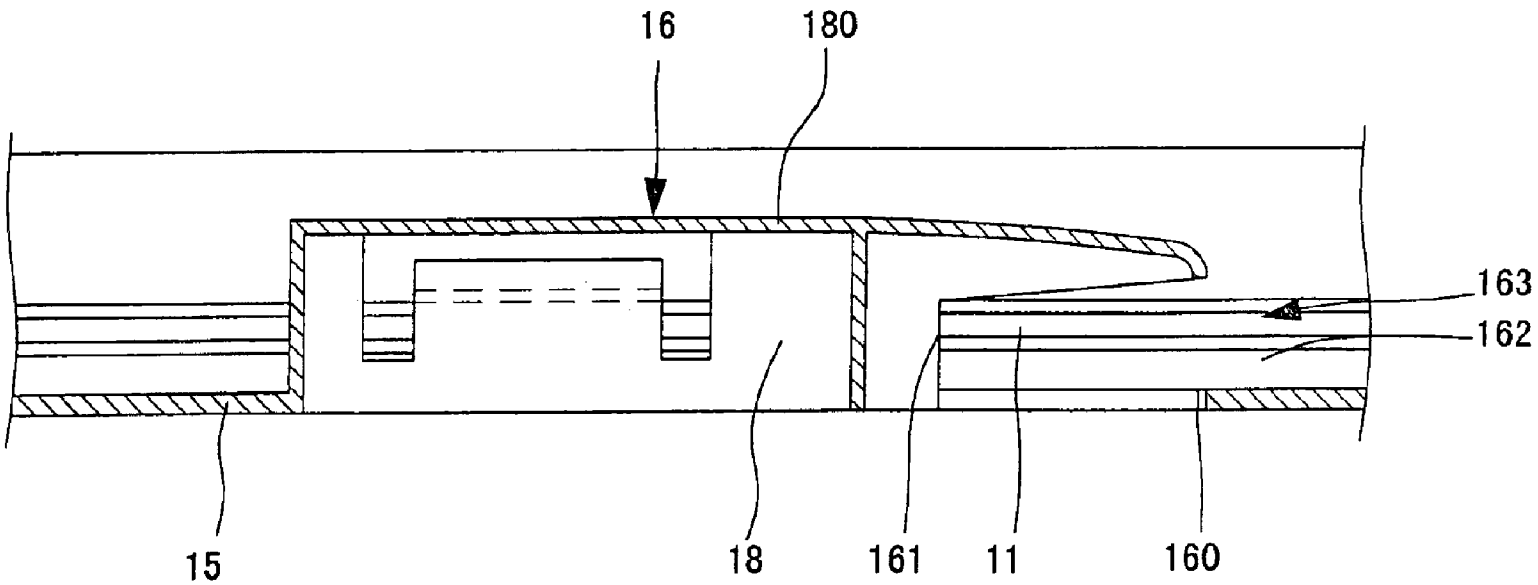
FIG. 3B is a sectional view taken along plane B—B in FIG. 2.
Figure 4:
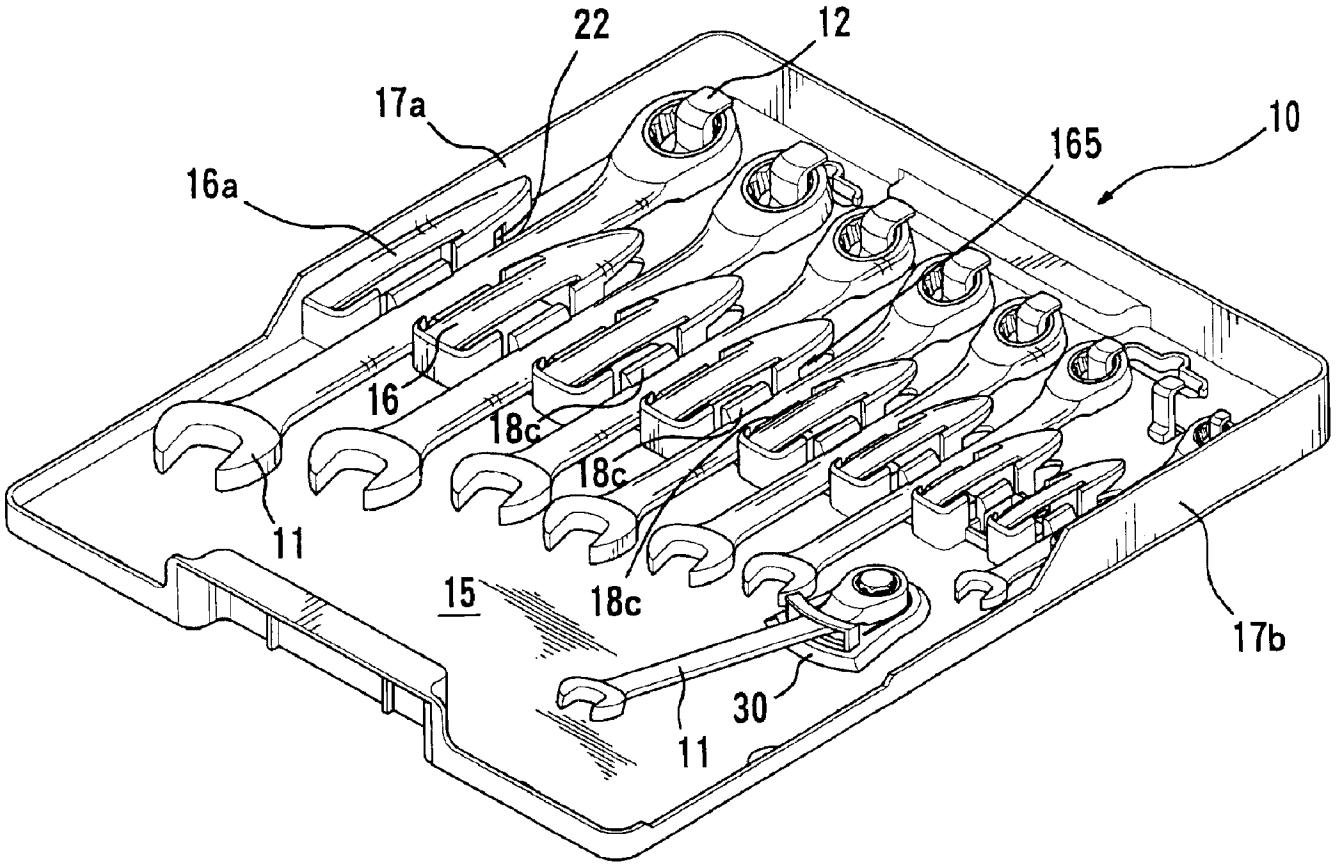
FIG. 4 is a perspective view illustrating try-on function of the tool rack in accordance with the present invention.
Figure 6:
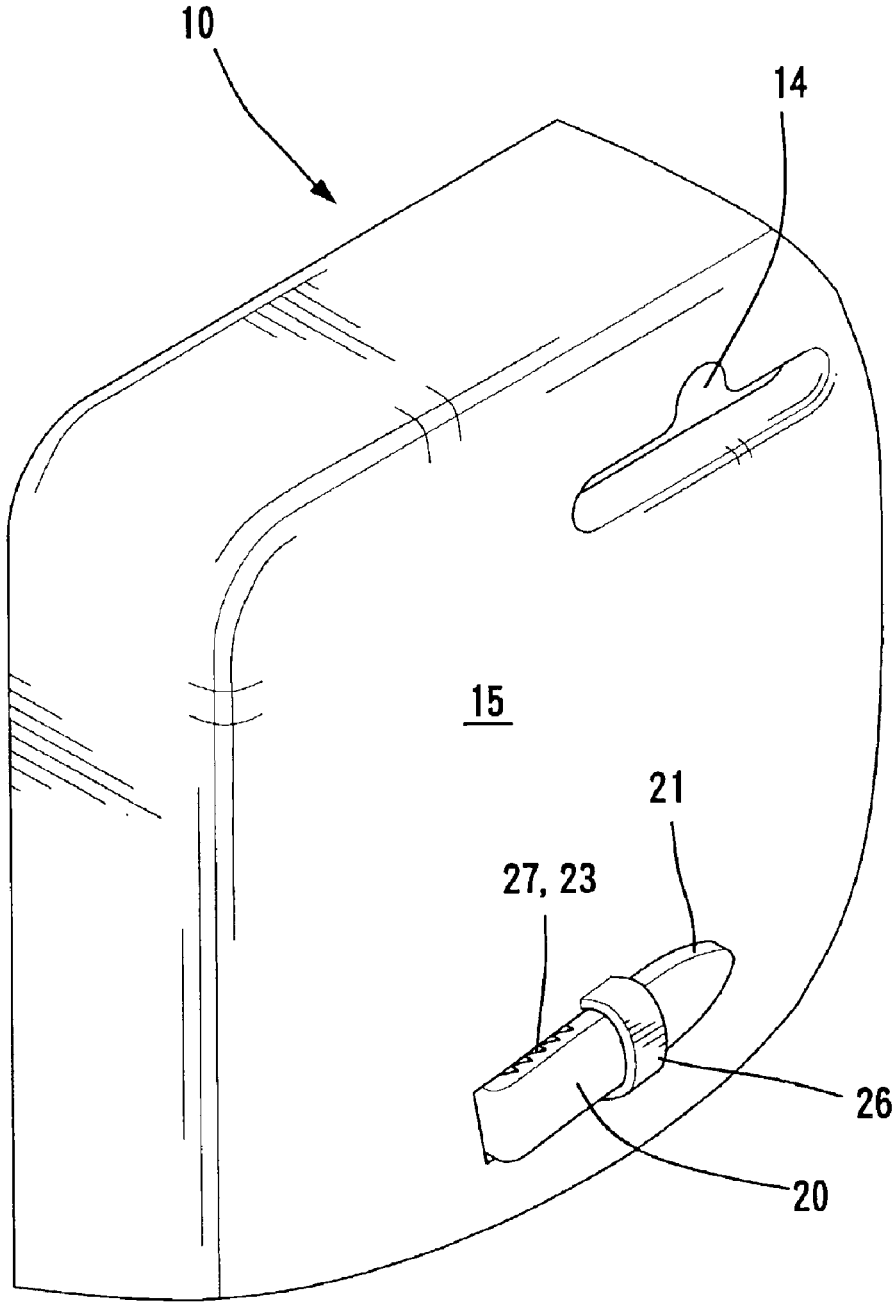
FIG. 6 is a view similar to FIG. 5, illustrating positioning of an end of the strap.
Figure 7:
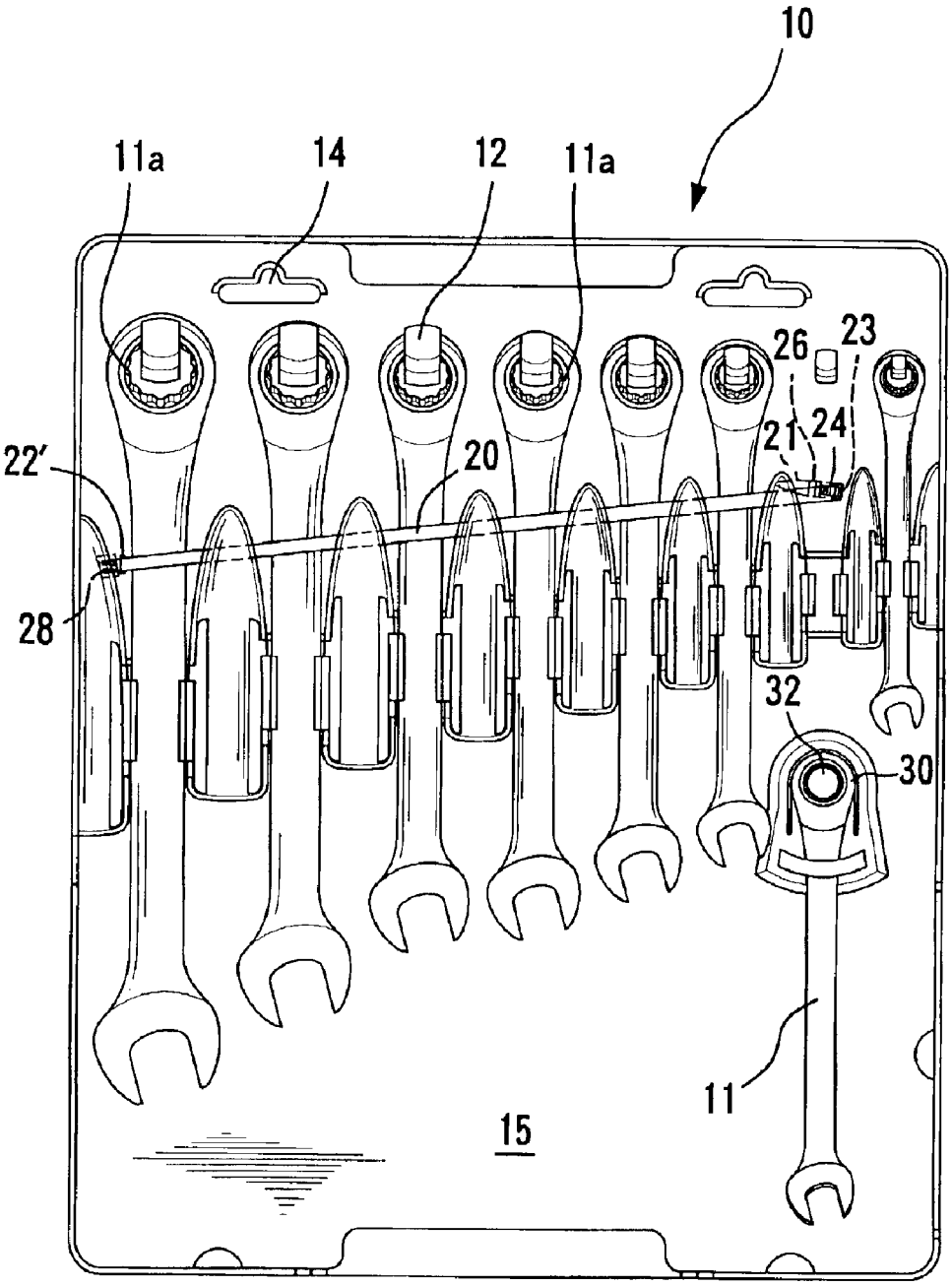
FIG. 7 is another modified embodiment of the tool rack in accordance with the present invention.

In addition, a flexible strap 20 is provided to tie the tools 11 to the main body 10. As illustrated in FIG. 3, a first end 28 of the strap 20 is retained to an inner wall face of a wall of the tool holding member 16*a* that defines the retaining hole 22. The strap 20 is placed across the tools 11 above the upper ends of the tool holding members 16 and slid through the openings 162 of the spaces 160 into the spaces 160 along a direction substantially parallel to the longitudinally extending tool holding seats of each tool 11 held and extended over all of the tools 11 with a second end 21 of the strap 20 wound around a wall of the tool holding member 16*b* on the left side wall 17*b*. The space 160 between each tool holding member 16 and the board 15 allows easy and rapid extension of the strap 20 across the tools 11, as the strap 20 may simultaneously slide into all of the spaces 160 via the opening 162 of each space 160 along a direction substantially parallel to the longitudinally extending tool holding seats of each tool 11, best shown in FIG. 3A. Next, the second end 21 of the strap 20 is passed through an underside of the rightmost tool 11 and then extended through the through-hole 25, as shown in FIG. 3. Alternatively, the second end 21 of the strap 20 is directly extended through the through-hole 25 of the board 15 if there is no tool retained in the leftmost tool holding seat, as shown in FIGS. 3A and 7. The second end 21 of the strap 20 includes a toothed portion 23 (FIG. 3) for engaging with the retaining teeth 27, thereby tying up all of the tools 11 to the board 15. Next, a distal portion of the second end 21 of the strap 20 is passed through the retaining member 26 to thereby retain the distal portion of the second end 21 of the strap 20 in place, best shown in FIGS. 6 and 7. It is noted that the toothed portion 23 is located on a side of the strap 20 in an appropriate section for engaging with the retaining teeth 27 that is formed on either the upper side (FIG. 2) or the underside (FIG. 5) of the board 15.

The retaining teeth 27 are preferably ratchet teeth. By means of the arrangement of engagement between the toothed portion 23 of the strap 20 and the retaining teeth 27, passage of the strap 20 from the upper side of the board 15 to the underside of the board 15 is easy, and the reverse operation is not so easy. More specifically, in a case that the retaining teeth 27 is formed on the upper side of the board 15, the strap 20 can be passed from the underside of the board 15 to the upper side of the board 15 only when the strap 20 is kept at a right angle with respect to the board 15 during the passage of the strap 20. The distal portion of the second end 21 of the strap 20 is further retained in place by the retaining member 26. Furthermore, in the most preferred form, notches 165 are formed in one or more of the tool holding members 16 in each side of the panel 18 in the inner edge of the cutout 163 adjacent the edges 161 and of a size for slideable receipt of the strap 20. Once the strap 20 is positioned over the tools 11 and within the spaces 160 and notches 165 and the strap 20 is held in a tight manner by the retaining teeth 27, the tools 11 are held securely by the upwardly extending hooks 12, the tool holding members 16, 16*a* and 16*b*, and the strap 20. As a result, during display, it will take a thief considerable time before he or she can remove the strap 20 and steal the tools 11, and such action will be very obvious and can be observed and stopped.

It is noted that the retaining hole 22 can be defined in the left side wall 17*a* instead of the tool holding member 16*a* without affecting its function. In addition, other types of the tool holding members can be used to retain the tools in place.

FIG. 7 illustrates a modified embodiment of the tool rack, wherein the board 15 includes a hole 22' to which the first end 28 of the strap 20 is retained. The strap 20 is extended over at least one tool 11 and then extended downwardly through the through-hole 25 with a distal portion of the second end 21 of the strap 20 being passed through and thus retained in place by the retainer member 26.

Figure 8:
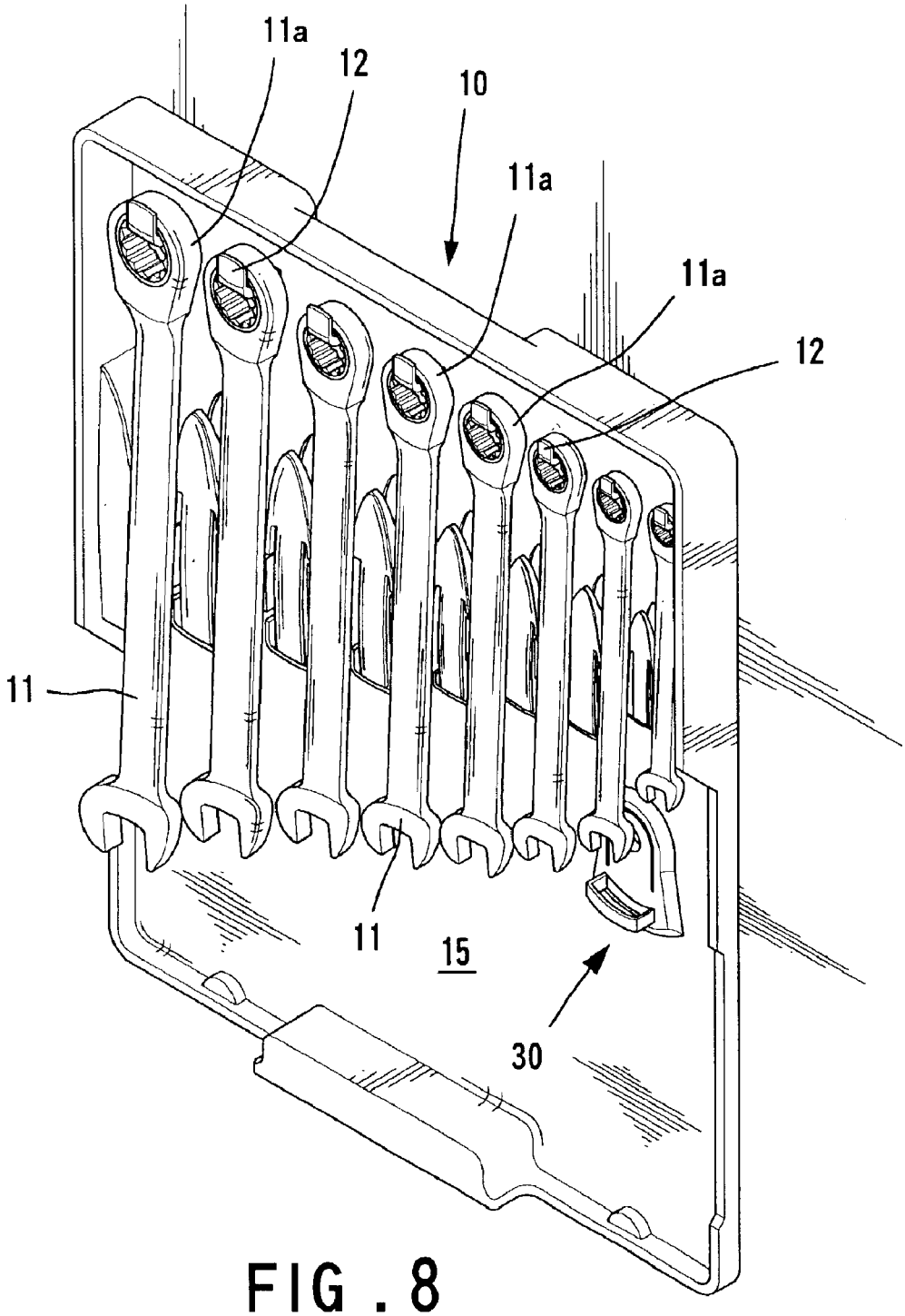
FIG. 8 is a perspective view of the tool rack in accordance with the present invention, illustrating use of the hooks of the tool rack.
Figure 9:
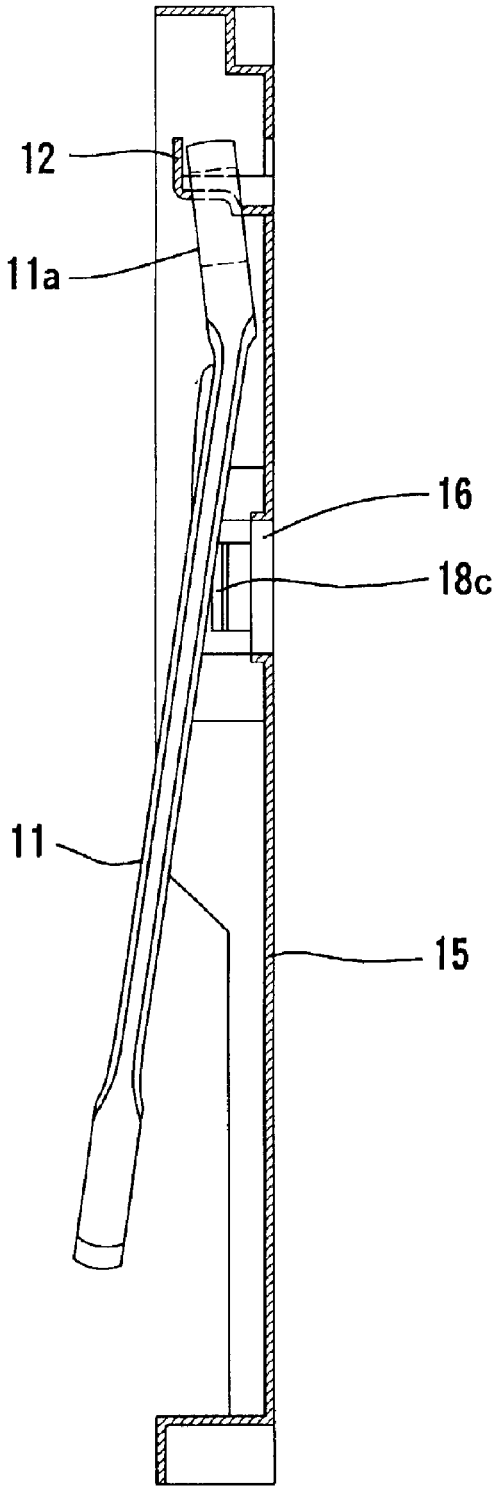
FIG. 9 is a sectional view of the tool rack in FIG. 8.

FIGS. 8 and 9 of the drawings show an advantage provided by the tool rack in accordance with the present invention. When the tool rack is used indoors, the tool rack is hung up to a wall. It is not necessary to retain every tool 11 in place by the respective tool holding member 16, as it would require a troublesome procedure to retrieve the tool 11. Instead, the box end 11*a* of the tool 11 may be simply hung on an associated upwardly-extending hook 12 with the outer surface of the tool 11 (where the surface between the tool end 11*a* and the handle or remaining portion of the tool 11 has an angle greater than 90°) located inwardly adjacent the board 15 and the inner surface of the tool (where the surface between the tool end 11*a* and the handle or remaining portion of the tool 11 has the obtuse angle) located outwardly of the board 15 and without the need of being retained in place by the associated tool holding member 16. Thus, the user may retrieve the tool 11 with little effort. It is noted that the tool 11 lies on the associated resilient hooks 18*c* of the associated tool holding members 16, 16*a* and 16*b*, best shown in FIG. 9. Of course, when the tool rack is to be used outdoors or to be carried by the user, the tool 11 can also be retained in place by the associated tool holding member 16 in addition to being hooked to the upwardly extending hook 12, as shown in FIG. 1.

The tool rack in accordance with the present invention provides a display function. In addition, it allows a customer to try one of the tools 11. The customer may insert the tool 11 through the bracket 34 and engage an end 11*a* of a tool (such as a spanner or wrench) with the rotary element 32 of the rotary member 30 and rotate the tool to feel the rotation before buying it. The rotary element 32 generates clicks during rotation to attract the customer. It should be appreciated that the cut 31 allows the portion of the board 15 within the cut 31 to cant relative to the remaining portions of the board 15 such that the rotary element 32 pivots about an axis which is not perpendicular to the plane of the board 15 to match the angle of the box end 11*a* while the remaining portion of the tool 11 can abut the board 15.

The hanging holes 14 allow the tool rack to be hung up to a wall. The upwardly extending hooks 12 not only prevent tools from falling from the tool rack that generally happens in conventional tool racks hung up to a wall, but also provide convenient retrieval of the tools of the type having at least one box end, which eliminates the problem of the tool holder of U.S. Pat. No. 5,931,299. In addition, the strap 20 provides an anti-theft function that is more reliable than conventional designs. Further, the space 160 between each tool holding member 16 and the board 15 allows rapid tying up of the tools 11 while the strap disclosed in U.S. Pat. No. 5,730,303 has to be troublesomely passed through the slot on each tool holding member.

Although the invention has been explained in relation to its preferred embodiment, it is to be understood that many other possible modifications and variations can be made without departing from the scope of the invention as hereinafter claimed.

What is claimed is:

1. A tool rack for a plurality of tools comprising:

a board;

a plurality of tool holding members defining a plurality of longitudinally extending tool holding seats each for holding one of the plurality of tools, each said tool holding member having first and second longitudinally spaced ends, with a space being defined by and between the board and at least one of the tool holding members, each said space having an opening at one of the first and second longitudinal ends of the tool holding member; and a strap slidable perpendicular to the longitudinally extending tool holding seats and extendable over the plurality of longitudinally extending tool holding seats of the tool holding members, said strap being simultaneously slidable through the openings into the spaces along a direction substantially parallel to the longitudinally extending tool holding seats, with said strap being releasably attached to said board, thereby adapted to retain said at least one of the plurality of tools in place in the plurality of longitudinally extending tool holding seats;

each of the plurality of tool holding members comprising a panel extending outwardly from the board and a top integrally formed with the panel and extending generally parallel to the board, with the space formed by a cutout in the panel of the tool holding member.

2. The tool rack as claimed in claim 1, with the cutout terminating in an edge, with the space being generally U-shaped perpendicular to the board and defined by the top, the board, and the edge of the cutout.

3. The tool rack as claimed in claim 2, with the strap including a first end and a second end, with said first end of said strap being securely attached to said board, with the board including a retaining portion, wherein said retaining portion of said board includes a through-hole and a plurality of retaining teeth formed on one of an upper side and an underside of said board and adjacent to said through-hole, said second end of said strap being extended through said through-hole of said board, said second end of said strap including a toothed portion for engaging with said retaining teeth on said board.

4. The tool rack as claimed in claim 1, with the strap including a first end and a second end, with said first end of said strap being securely attached to said board, with the board including a retaining portion, wherein said retaining portion of said board includes a through-hole and a plurality of retaining teeth formed on one of an upper side and an underside of said board and adjacent to said through-hole, said second end of said strap being extended through said through-hole of said board, said second end of said strap including a toothed portion for engaging with said retaining teeth on said board.

5. The tool rack as claimed in claim 4, wherein said board includes a retainer member formed on the underside thereof, and wherein said second end of the strap has a distal portion that is passed through said retaining member and thus retained in place.

6. The tool rack as claimed in claim 4, wherein said board includes a retaining hole to which the first end of the strap is retained in place.

7. The tool rack as claimed in claim 6, wherein said board includes a side wall extending from a lateral side thereof, said retaining hole being defined in said side wall, with one of the plurality of tool holding members being formed on an inner face of the side wall.

8. The tool rack as claimed in claim 1, wherein said board further includes at least one hanging hole defined therein longitudinally above the first longitudinal ends of the plurality of tool holding members.

9. The tool rack as claimed in claim 8, wherein said board further includes a plurality of upwardly extending hooks formed above the first longitudinal ends of the plurality of tool holding members, each said upwardly extending hook being aligned with one of the longitudinally extending tool holding seats and for hanging a box end of each said tool when the board is hung vertically on the at least one hanging hole with the tool extending vertically in the longitudinally extending tool holding seat.

10. The tool rack as claimed in claim 9, with the upwardly extending hooks having differing extents outwardly of the board which are configured to correspond to the extent of the box end of the tool perpendicular to the board when the tool is received in the longitudinally extending tool holding seat.

11. The tool rack as claimed in claim 1, with at least one of the spaces including a notch for slideable receipt of the strap, with the panel including two sides, with the notch being formed in each of the sides of the panel and in communication with the cutout, with the strap when received in the notch being restricted from moving in the direction substantially parallel to the longitudinally extending tool holding seats.

12. The tool rack as claimed in claim 11, with the cutout terminating in an edge, with the space being generally U-shaped perpendicular to the board and defined by the top, the board, and the edge of the cutout.

13. A tool rack for a plurality of tools comprising:

a board;

a plurality of tool holding members defining a plurality of longitudinally extending tool holding seats each for holding one of the plurality of tools, each said tool holding member having first and second longitudinally spaced ends, with a space being defined by and between the board and at least one of the tool holding members, each said space having an opening at one of the first and second longitudinal ends of the tool holding member; and a strap slidable perpendicular to the longitudinally extending tool holding seats and extendable over the plurality of longitudinally extending tool holding seats of the tool holding members, said strap being simultaneously slidable through the openings into the spaces along a direction substantially parallel to the longitudinally extending tool holding seats, with said strap being releasably attached to said board, thereby adapted to retain said at least one of the plurality of tools in place in the plurality of longitudinally extending tool holding seats, with at least one of the spaces including a notch for slideable receipt of the strap, with the strap when received in the notch being restricted from moving in the direction substantially parallel to the longitudinally extending tool holding seats.

14. The tool rack as claimed in claim 13, with the strap including a first end and a second end, with said first end of said strap being securely attached to said board, with the board including a retaining portion, wherein said retaining portion of said board includes a through-hole and a plurality of retaining teeth formed on one of an upper side and an underside of said board and adjacent to said through-hole, said second end of said strap being extended through said through-hole of said board, said second end of said strap including a toothed portion for engaging with said retaining teeth on said board.

15. A tool rack for a plurality of tools each having a box end comprising:

a board having an upper end;

at least one hanging hole being defined in the board for hanging the board in a vertical orientation;

a plurality of tool holding members defining a plurality of longitudinally extending tool holding seats each for holding one of the plurality of tools, with each of the plurality of longitudinally extending tool holding seats being vertical when the board is hung in the vertical orientation by the at least one hanging hole; and a plurality of upwardly extending L-shaped hooks on the upper end of the board above the tool holding members when the board is hung in the vertical orientation by the at least one hanging hole, with each said upwardly extending L-shaped hook including a first portion extending in a direction generally perpendicular to the board and a second portion extending from the first portion spaced from the board and in a direction generally parallel to the board, with the first portion of each said upwardly extending L-shaped hook being aligned with one of the longitudinally extending tool holding seats with the second portion extending from the first portion parallel to and away from the longitudinally extending tool holding seat, with the upwardly extending L-shaped hooks being capable of hanging said box end of each said tool without said tool being retained in place in the longitudinally extending tool holding seat.

16. The tool rack as claimed in claim 15, with the second portions of the upwardly extending L-shaped hooks having differing extents outwardly of the board which are configured to correspond to the extent of the box end of the tool perpendicular to the board when the tool is received in the longitudinally extending tool holding seat.

17. The tool rack as claimed in claim 15, with the first portions of the plurality of upwardly extending L-shaped hooks being arranged horizontally when the board is hung in the vertical orientation by the at least one hanging hole, with the plurality of tool holding members having a decreasing size horizontally across the board when the board is hung in the vertical orientation by the at least one hanging hole.

* * * * *